US006099114A

United States Patent [19]

Sasaki

[11] Patent Number: 6,099,114

[45] Date of Patent: Aug. 8, 2000

[54] INK CARTRIDGE AND INK JET PRINTER

[75] Inventor: Toyonori Sasaki, Anjo, Japan

[73] Assignee: Brother Kogyo Kabushiki Kaisha, Nagoya, Japan

[21] Appl. No.: 08/936,681

[22] Filed: Sep. 24, 1997

[30] Foreign Application Priority Data

Oct. 9, 1996 [JP] Japan ..... 8-268154

[51] Int. Cl.[7] ..... B41J 2/175

[52] U.S. Cl. ..... 347/86

[58] Field of Search ..... 347/7, 85, 86, 347/87

[56] References Cited

U.S. PATENT DOCUMENTS 5,486,855 1/1996 Carlotta et al. ..... 347/87

FOREIGN PATENT DOCUMENTS 6-238908 8/1994 Japan .

*Primary Examiner*—N. Le

*Assistant Examiner*—Anh T. N. Vo

*Attorney, Agent, or Firm*—Oliff & Berridge, PLC

[57] ABSTRACT

An ink cartridge in accordance with the invention includes a cartridge case. The cartridge case defines an ink supply hole, an air communicating hole, an ink chamber adjacent the ink supply hole and a foam chamber adjacent the air communicating hole. The ink chamber and foam chamber communicate with each other via a communicating section at a lower end of the cartridge case. A porous member for occluding ink is disposed within the foam chamber. An ink filling device supplies ink to the foam chamber via the ink supply hole. A flow regulating member guides the supplied ink upwardly in the ink chamber when the ink is supplied by the ink filling device. Thus, ink can be supplied to the foam chamber efficiently and without leaving air in the ink chamber.

20 Claims, 6 Drawing Sheets

INK CARTRIDGE AND INK JET PRINTER

BACKGROUND OF THE INVENTION

1. Field of the Invention

The invention relates to an ink jet printer and an ink cartridge containing ink to be used in the ink jet printer.

2. Description of Related Art

Conventionally, an ink jet printer for recording an image on a recording sheet by projecting droplets of ink includes a recording device in which an ink jet print head and an ink cartridge containing ink to be supplied to the print head are replaceably mounted in a printer case, a conveying device for conveying the recording sheet, and a carriage device for reciprocally moving the recording device in accordance with the size of the recording sheet to be conveyed by the conveying device.

The conveying device rotates a platen roller, the axis of which is parallel with the direction of reciprocal motion of the recording device, to convey the recording sheet in a direction perpendicular to the direction of reciprocal motion of the recording device.

The carriage device slidably supports a carriage mounted with the recording device on a guide rod that is parallel to the axis of the platen roller, and reciprocally moves the carriage in the direction of the axis of the platen roller via a belt installed between drive and driven pulleys which are driven by a motor.

Examples of the ink cartridge used in the above-described ink jet printer are shown in FIGS. 6–8.

The interior of a cartridge case 102 of the ink cartridge 101 is divided into a foam chamber 104 for containing an ink-impregnated porous member 103 (e.g., a foamed plastic having an ink occluding property) and an ink chamber 105 containing the ink. Furthermore, a communicating hole 107 connecting the foam chamber 104 with the ink chamber 105 is formed beneath a wall section 106 that divides the foam chamber 104 from the ink chamber 105.

The porous member 103 is inserted into the interior of the foam chamber 104 through an opening 108 provided in one side of the cartridge case 102. The opening 108 of the cartridge case 102 is closed by a cover 109 subsequent to insertion of the porous member 103. The cartridge case 102 is provided, on the ink chamber 105 side, with an ink supply hole 110 for supplying the ink to a recording head, which is not shown in FIG. 6. An air communicating hole 111 is formed on the foam chamber 104 side of the cartridge case 102 for maintaining the interior of the cartridge case 102 at atmospheric pressure in order to smoothly supply the ink to the print head through the ink supply hole 110.

The above-described ink cartridge 101 is disclosed in JP-A-6-238908 wherein the air contained in the ink that is impregnated in the porous member 103 is separated. The separated air remains within the ink chamber 105 so that the ink to be supplied to the print head is free of air, thereby preventing defective emission of the ink.

In the above-described ink cartridge 101, an ink filling hole for supplying ink to the porous material 103 is provided in addition to the ink supply hole 110 and the air communicating hole 111. The ink is supplied through the ink filling hole to soak the porous material 103 with the ink. However, the ink filling hole must be closed after filling, which increases the number of processes.

To cope with this disadvantage and obviate the above-described ink filling hole, it is considered to supply the ink to the porous material 103 through the ink supply hole 110.

However, the ink, if supplied to the porous material 103 through the ink supply hole 110, will contact the partition wall section 106 which separates the foam chamber 104 from the ink chamber 105, which will disturb the flow of the ink. In this case, the air is likely to remain within the ink chamber 105 after ink is supplied to the porous material 103.

The residual air in the ink chamber 105 forms bubbles in the ink due to the high-speed movement of the carriage mounted with the ink cartridge 101. The bubbled ink, if supplied to the print head side of the ink cartridge 101, will cause unstable ink emission which adversely affects printing quality.

Also, when the ink is drawn into the print head after purging the air, the purged air reduces the suction force, which results in ineffective separation of air from the ink. Accordingly, the print head is not completely filled with ink. This also will adversely affect the printing quality.

However, if the ink is supplied to the ink cartridge 101 slowly, it becomes possible to fill the ink chamber 105 with the ink without the above-described residual air in the ink chamber 105. In this case, however, it takes longer to supply ink to the ink cartridge 101, which decreases manufacturing efficiency of the ink cartridge 101.

SUMMARY OF THE INVENTION

In view of the above-described disadvantages of the conventional devices, it is an object of the invention to provide an ink cartridge capable of efficiently filling the ink chamber with ink without residual air staying in the ink chamber, and an ink jet recording device using the same.

A cartridge case in accordance with the invention includes an ink supply hole and an air communicating hole. The cartridge case forms an ink chamber at the ink supply hole side and a foam chamber that houses a porous member for occluding the ink at the air communicating hole side. Both chambers are connected to each other through a communicating section located thereunder. The ink is supplied to the foam chamber by ink filling means through the ink supply hole. A flow regulating member guides the ink supplied to the foam chamber upwardly in the ink chamber when the ink is supplied by the ink filling means.

Therefore, when the ink is supplied to the foam chamber by the ink filling means, the ink to be supplied is guided upwardly in the ink chamber by the flow regulating member, so that the ink emission can be performed efficiently without leaving air inside the ink chamber.

The flow regulating member is a flow regulating plate member that shields at least the lower part of the ink filling hole, and therefore does not complicate the structure of the ink cartridge.

Furthermore, the flow regulating member is a flow regulating plate member that has an inclined surface for guiding the ink upwardly in the ink chamber when the ink is supplied to the foam chamber by the ink filling means. Thus, when the ink is supplied to the foam chamber by the ink filling means, the inclined surface effectively improves a flow regulating effect by guiding the ink upwardly in the ink chamber.

The ink to be supplied to the foam chamber can effectively be guided upwardly in the ink chamber by the flow regulating plate member which is disposed so to extend upwardly above the ink supply hole.

In the ink jet recording device for printing by the use of the aforementioned ink cartridge, when air is purged from the ink, a substantial purge pressure acts to insure that ink is supplied.

BRIEF DESCRIPTION OF THE DRAWINGS

A preferred embodiment of the invention will be described in detail with reference to the following figures, wherein.

DETAILED DESCRIPTION OF THE PREFERRED EMBODIMENTS

Preferred embodiments of the invention will hereinafter be described with reference to the accompanying drawings.

Figure 1:
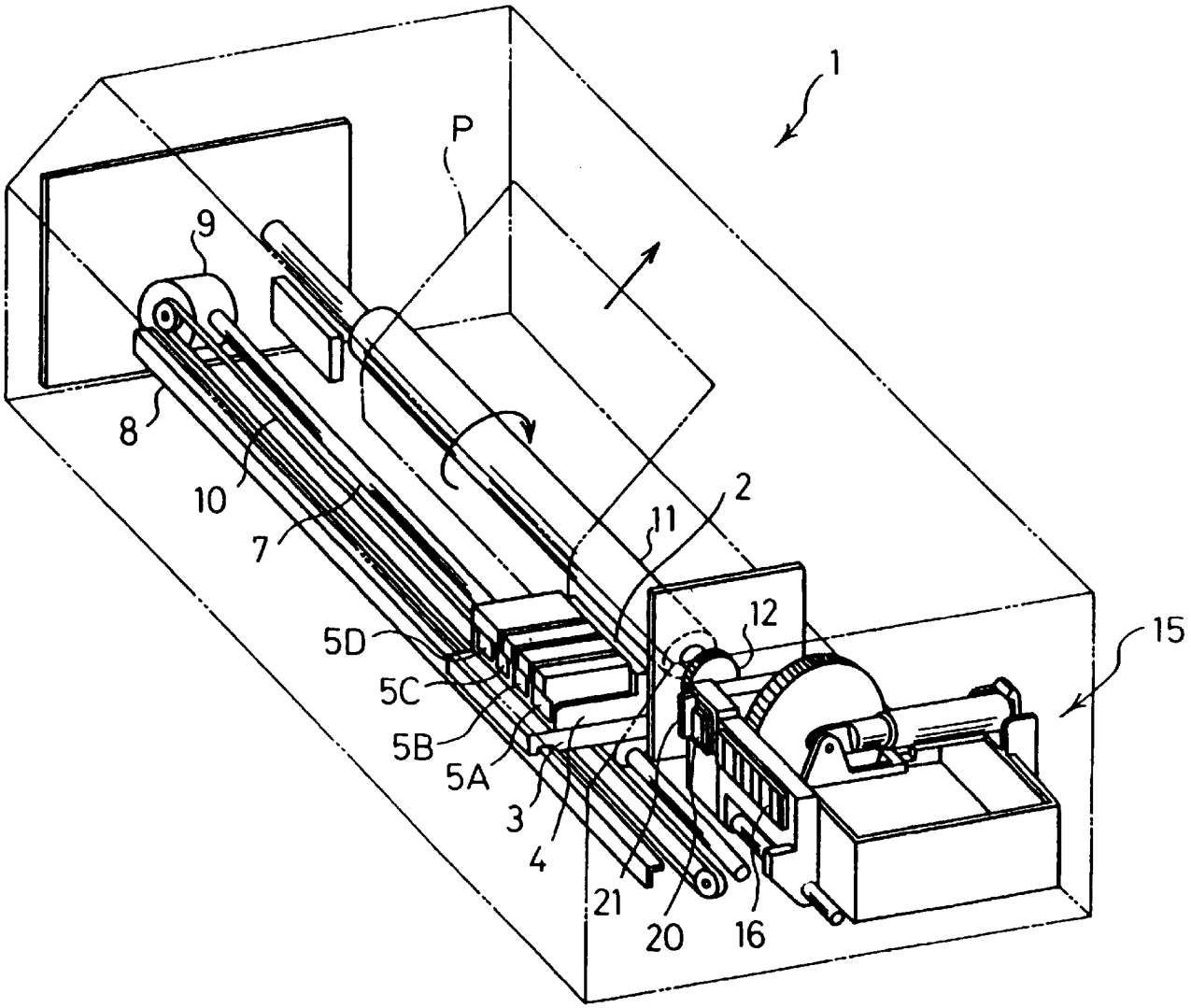
FIG. 1 is a perspective view showing an ink jet printer mounted with an ink cartridge according to one embodiment of the invention.

FIG. 1 is a perspective view showing the structure of a color ink jet printer. The color ink jet printer has an ink jet print head 2 for printing by projecting four colors of ink, i.e., cyan, magenta, yellow and black, onto a printing paper P. The print head 2 is provided with four nozzles for injecting the ink of each of the four colors. The print head 2 is integrally held by a head unit 4 on a carriage 3, which moves reciprocally in a straight direction during printing. Furthermore, ink cartridges 5A, 5B, 5C and 5D are removably mounted on the head unit 4, and supply the four-color ink to the print head 2. The front portion of the carriage 3 is supported on a carriage shaft 7, along which the carriage 3 can move. The rear portion of the carriage 3 is slidably supported on a guide plate 8. The reciprocating movement of the carriage 3 is driven by a carriage driving motor 9 via a belt 10.

A platen roller 11 is provided opposite the print head. The platen roller 11 is driven by the driving force transmitted from a line feed motor, which is not shown, via the platen gear 12. The printing paper P is carried by the platen roller 11 to a position opposite the print head 2, where printing is performed. A purging device 15 is mounted on one side of the platen roller 11. The print head 2 is subject to the drawback that defective ink emissions occur due to the presence of air bubbles inside and the attachment of ink drops on the ink emission surface during use. The purging device 15 is provided to obviate this drawback. The purging device 15 is also driven when the print head 2 or the ink cartridges 5A–5D have been replaced, in order to absorb the ink from the nozzle of the print head 2 so that the ink is smoothly supplied from inside the cartridge to the print head 2.

A capping device 16 for protecting the print head is mounted in front of the purging device 15. A suction cap 20 for purging the print head 2 is provided on the print area side of the capping device 16. The capping device 16 moves in the direction of the nozzle of the print head 2 when the carriage 3 has moved to the capping position, contacting the periphery of the nozzle. Thus, the nozzle section is closed to prevent the nozzles and ink from drying. On the suction cap 20 side, there is provided a wiper 21 for wiping the nozzles of the print head 2.

Figure 2:
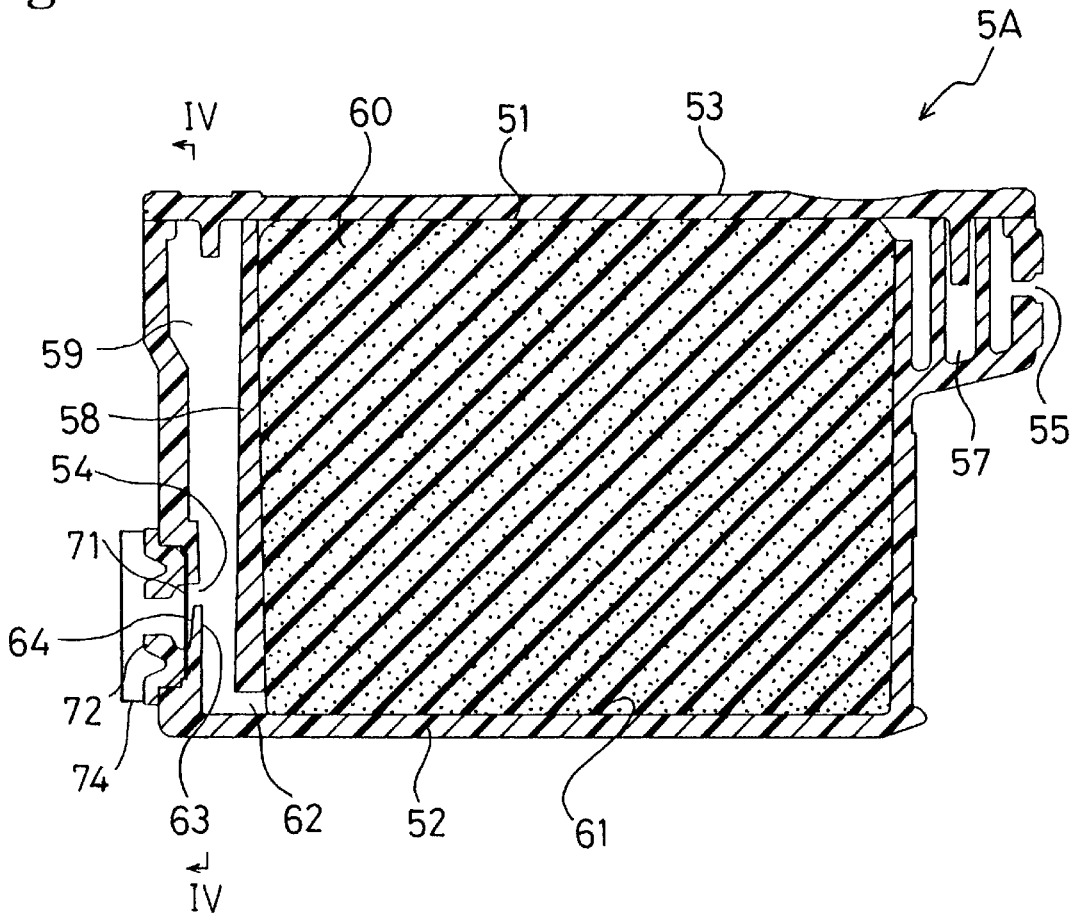
FIG. 2 is a schematic elevational view of the ink cartridge according to the invention.
Figure 3:
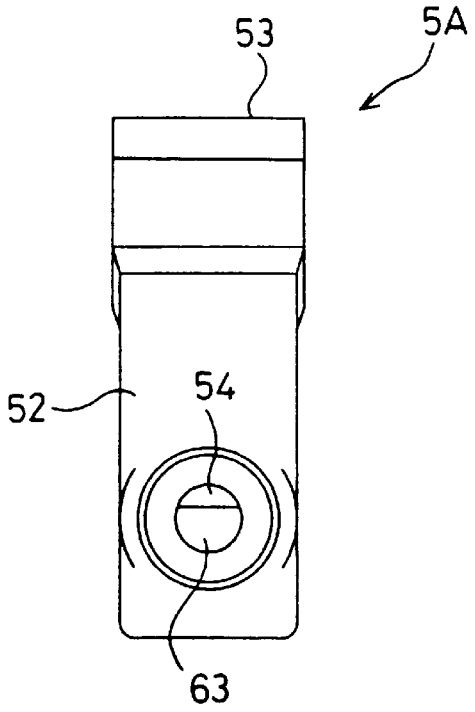
FIG. 3 is a schematic elevational view of the ink cartridge according to the invention.
Figure 4:
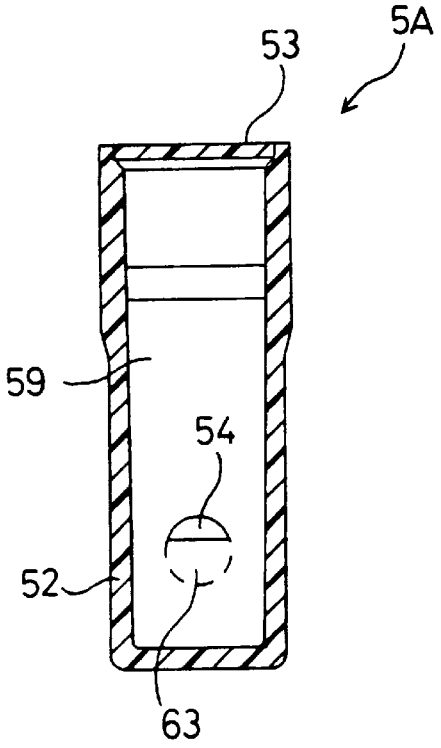
FIG. 4 is a sectional view taken along plane IV—IV of FIG. 2.

Next, the ink cartridges 5A–5D will be explained with reference to FIGS. 2–4. The following explanation only discusses ink cartridge 5A, but is similarly applicable to other ink cartridges.

The ink cartridge 5A has a box-shaped cartridge case 52 which is open at the upper surface and defines an opening 51. The opening 51 of the cartridge case 52 is closed by a cover 53.

An ink supply hole 54 is provided on one side of the cartridge case 52 to supply the ink to the print head 2. An air communicating hole 55 is formed on the other side of the cartridge case 52, which is used when the air pressure in the cartridge case 52 is kept at atmospheric pressure. On the side where the air communicating hole 55 of the cartridge case 52 is formed, an air buffer 57 is formed to prevent ink evaporation through the air communicating hole 55.

The interior of the cartridge case 52 is separated into two chambers by a wall section 58. An ink chamber 59 is formed on the ink supply hole 54 side of the cartridge case 52. On the air communicating hole 55 side of the cartridge case 52, a foam chamber 61 is formed which houses an ink-occluding porous member 60. The porous member 60 includes an ink-occluding foamed plastic. The ink chamber 59 and the foam chamber 61 are connected to each other through a communicating portion 62 formed under the wall section 58.

The porous member 60 is inserted in a compressed state into the foam chamber 61 through the opening 51 provided in the upper surface. The ink which is free of air is supplied by an ink filler 74 (schematically shown), through the ink supply hole 54.

The ink supply hole 54 is provided with a flow regulating plate 63 for shielding the lower part of the ink supply hole 54. The flow regulating plate 63 guides the ink upwardly in the ink chamber 59 when supplied by the ink filler 74. The flow regulating plate 63 has an inclined surface 64 for guiding the ink upwardly in the ink chamber 59.

Furthermore, the ink supply hole 54 is provided with a mesh filter 71 for removing foreign substances from the ink to be supplied to the print head. The ink supply hole 54 is also provided with an adapter 72 for connecting the ink cartridge 5A to the print head and the ink filler 74.

Next, the operation of supplying ink to the ink cartridge 5A of the above-described structure will be explained.

First, the porous member 60 is inserted through the opening 51 into the foam chamber 61 of the cartridge case 52. The porous member 60, which is normally 1.5 to 8 times as large as the volume of the foam chamber 61, is compressed and pressed into the foam chamber 61.

Then, the cover 53 is fixedly attached to the opening 51 by thermal welding or ultrasonic welding.

Next, the ink filler 74 is connected to the ink supply hole 54 via the adapter 72 to supply the ink. First, prior to supplying the ink, evacuating means is applied to the air communicating hole 55 to evacuate the ink cartridge SA.

Then, with the interior of the ink cartridge 5A kept at a predetermined negative pressure of approximately −710 mmHg, the ink filler starts to supply ink. The supplied ink, after passing through the filter 71, contacts the flow regulating plate 63 which prevents it from flowing straightforward. However, since the negative pressure has been built up in the interior of the ink cartridge 5A, the ink is absorbed into the ink cartridge 5A by both the straightforward pressure and an upward pressure. The ink thus supplied, utilizing the upward pressure, flows upwardly in the ink chamber 59.

Particularly because the flow regulating plate 63 has the inclined surface 64, the ink thus supplied is efficiently guided upwardly in the ink chamber 59.

The ink guided upwardly in the ink chamber 59 is first supplied to the ink chamber 59, then flows to the foam chamber 61 side through the communicating hole 62, and becomes impregnated into the porous member 60. The ink, therefore, can be supplied to the ink cartridge 5A without leaving air in the ink chamber 59. In this case, it is unnecessary to decrease the speed which ink is supplied and therefore the ink filling efficiency is not decreased.

Also, when the ink cartridge 5A of the above-described ink jet printer 1 prints, no air is drawn in with the ink during the purging operation of the purging device 15. It is, therefore, possible to draw the ink into the print head with a substantial suction pressure, thereby enabling sufficient ink supply to the print head to achieve a quality printed image.

Figure 5:
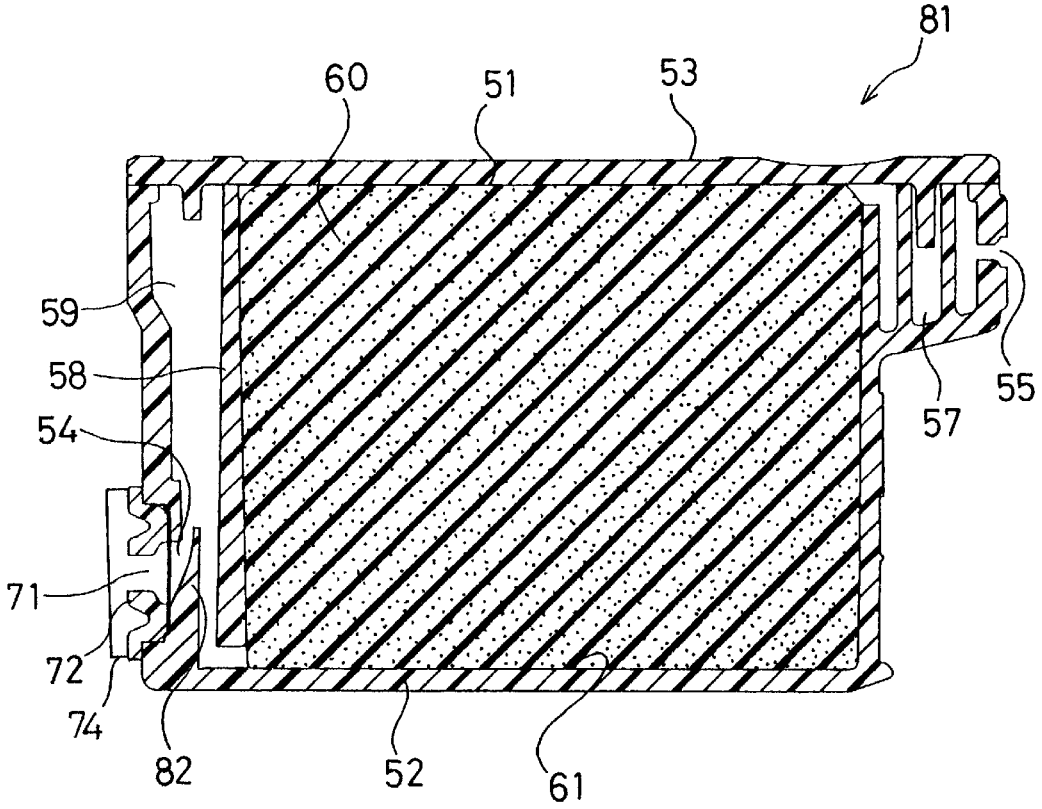
FIG. 5 is a schematic sectional view of the ink cartridge according to another embodiment of the invention.
Figure 6:
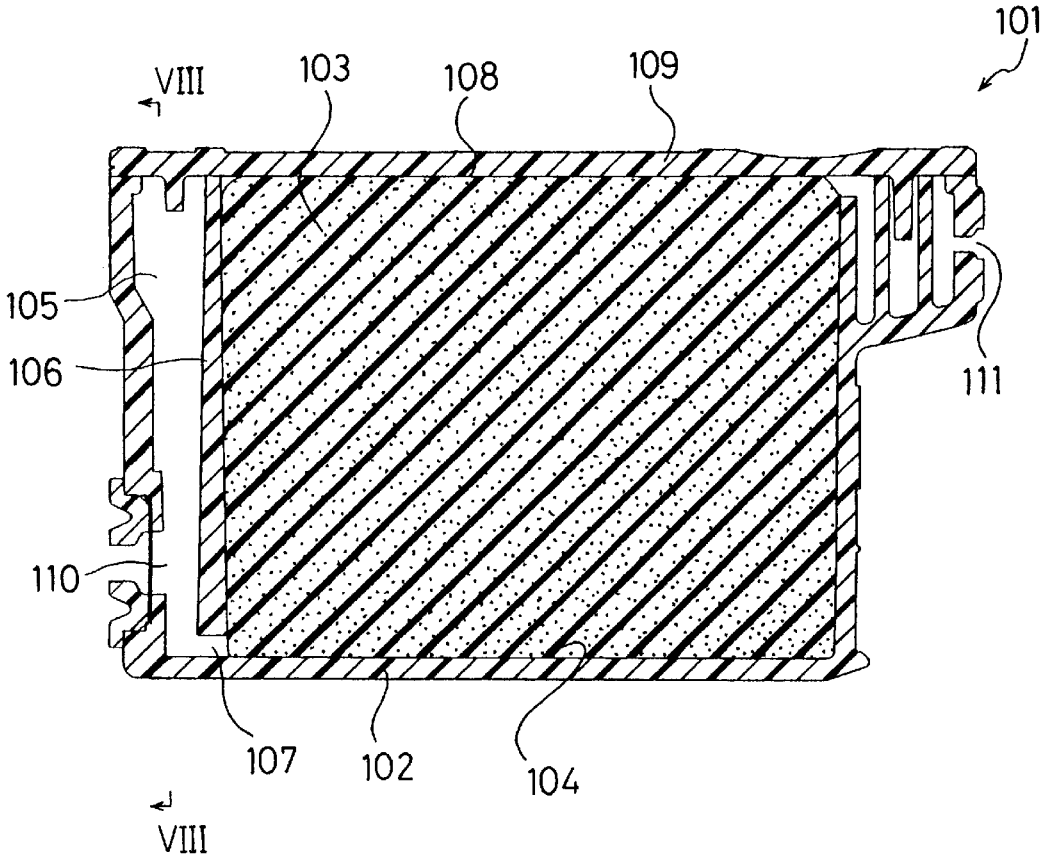
Fig.6 RELATED ART
FIG. 6 is a schematic sectional view of a related art ink cartridge.
Figure 7:
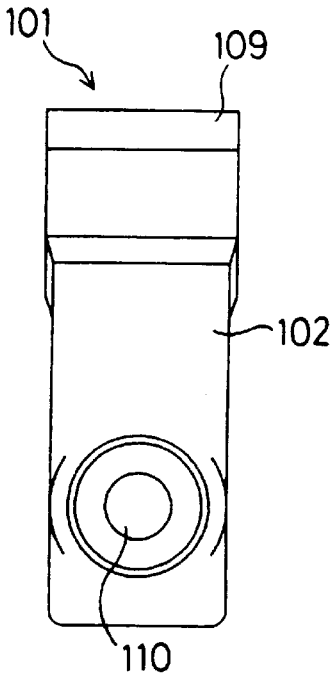
Fig.7 RELATED ART
FIG. 7 is a schematic front view of the related art ink cartridge of FIG. 6.
Figure 8:
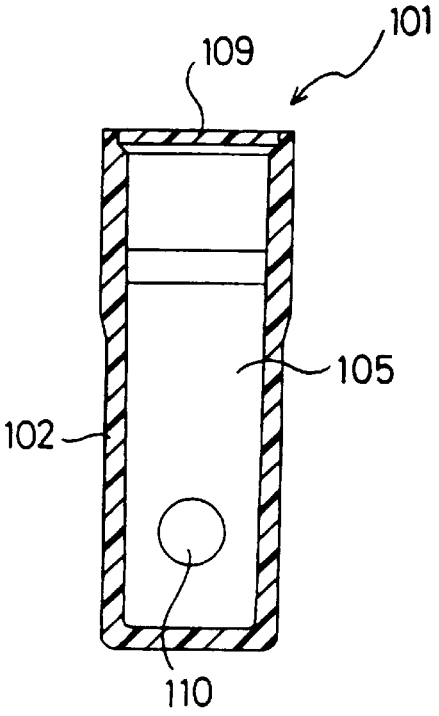
Fig.8 RELATED ART
FIG. 8 is a sectional view taken along plane VIII—VIII of FIG. 6.

It is to be noted that, in the above-described embodiment, the flow regulating plate 63 is designed to cover at least the lower part of the ink supply hole 54. However, the flow regulating plate 82, as shown in the ink cartridge 81 of FIG. 5, may be shifted a little inwardly from the ink supply hole 54 so that the forward end of the flow regulating plate 82 extends upwardly of the ink supply hole 54, thereby efficiently guiding the ink supplied through the ink supply hole 54 and upwardly in the ink chamber 59.

What is claimed is:

1. An ink cartridge having a cartridge case, the cartridge case defining an ink supply hole through which ink is supplied to a print head, an air communicating hole, an ink chamber adjacent the ink supply hole and a foam chamber adjacent the air communicating hole, the ink chamber and the foam chamber communicating with each other via a communicating section adjacent a bottom wall of the cartridge case, and wherein a porous member for occluding ink is disposed within the foam chamber, the ink cartridge comprising:

means for supplying ink to the foam chamber via the ink supply hole and the ink chamber; and means for guiding the supplied ink upwardly in the ink chamber as the ink is supplied by the means for supplying through the ink supply hole and into the ink chamber in a manner such that the ink is prevented from flowing to the communicating section directly from the ink supply hole.

2. The ink cartridge according to claim 1, wherein the means for guiding is a flow regulating plate member which shields at least a lower portion of the ink supply hole.

3. The ink cartridge according to claim 2, wherein the flow regulating plate member has an inclined surface for guiding the supplied ink upwardly in the ink chamber when the ink is supplied by the means for supplying.

4. The ink cartridge according to claim 3, wherein the flow regulating plate member extends upwardly above the ink supply hole.

5. An ink jet recording device comprising the ink cartridge of claim 1, the ink iet recording device printing by emitting ink onto a recording medium.

6. An ink cartridge having a cartridge case, the cartridge case defining an ink supply hole through which ink is supplied to a print head, an air communicating hole, an ink chamber adjacent the ink supply hole and a foam chamber adjacent the air communicating hole, the ink chamber and the foam chamber communicating with each other via a communicating section adjacent a bottom wall of the cartridge case, and wherein a porous member for occluding ink is disposed within the foam chamber, the ink cartridge comprising:

an ink filling device that supplies ink to the foam chamber via the ink supply hole and the ink chamber; and a flow regulating member that guides the supplied ink upwardly in the ink chamber as the ink is supplied by the ink filling device through the ink supply hole and into the ink chamber in a manner such that the ink is prevented from flowing to the communicating section directly from the ink supply hole.

7. The ink cartridge according to claim 6, wherein the flow regulating member is a flow regulating plate member which shields at least a lower portion of the ink supply hole.

8. The ink cartridge according to claim 7, wherein the flow regulating plate member has an inclined surface for guiding the supplied ink upwardly in the ink chamber when the ink is supplied by the ink filling device.

9. The ink cartridge according to claim 8, wherein the flow regulating plate member extends upwardly above the ink supply hole.

10. An ink jet recording device comprising the ink cartridge of claim 6, the ink iet recording device printing by emitting ink onto a recording medium.

11. A method of supplying ink to a cartridge case of an ink cartridge, the cartridge case defining an ink supply hole through which ink is supplied to a print head, an air communicating hole, an ink chamber adjacent the ink supply hole and a foam chamber adjacent the air communicating hole, the ink chamber and the foam chamber communicating with each other via a communicating section adjacent a bottom wall of the cartridge case, and wherein a porous member for occluding ink is disposed within the foam chamber, the method of supplying ink comprising the steps of:

supplying ink to the foam chamber via the ink supply hole and the ink chamber with an ink filling device; and guiding the supplied ink upwardly in the ink chamber as the ink is supplied by the ink filling device through the ink supply hole and into the ink chamber in a manner such that the ink is prevented from flowing to the communicating section directly from the ink supply hole.

12. The method according to claim 11, wherein the step of guiding the supplied ink includes shielding at least a lower portion of the ink supply hole with a flow regulating plate member.

13. The method according to claim 12, wherein the step of guiding the supplied ink includes guiding the supplied ink upwardly in the ink chamber, when the ink is supplied by the ink filling device, with an inclined surface of the flow regulating plate member.

14. The method according to claim 13, wherein the step of guiding the supplied ink includes guiding the supplied ink with the flow regulating plate member which extends upwardly above the ink supply hole.

15. The method according to claim 11, wherein the step of supplying ink to the foam chamber includes supplying ink to the ink chamber.

16. The method according to claim 15, wherein the step of supplying ink to the foam chamber includes filling the ink chamber with ink such that ink flows into the foam chamber via the communicating section.

17. An ink cartridge comprising:

a cartridge case, the cartridge case having an ink supply hole through which ink is supplied to a print head;

an ink chamber adjacent to the ink supply hole, the ink chamber being defined by the cartridge case, a foam chamber defined by the cartridge case, the foam chamber accommodating a porous member for occluding the ink, a communicating section formed at one end of the ink chamber, the ink chamber and the foam chamber communicating with each other via the communicating section; and a guide member, which is adjacent the ink supply hole, disposed in the ink chamber the guide member regulating flow of the ink poured from the ink supply hole to the other end of the ink chamber in a manner that the ink is prevented from flowing to the communicating section directly from the ink supply hole;

wherein the ink flows from the ink supply hole to the other end of the ink chamber, and flows from the other end to the one end of the ink chamber, and flows from the one end to the communicating section, and flows from the communicating section to the porous member in the foam chamber.

18. The ink cartridge according to claim 17, wherein the guide member is disposed at the cartridge case on the opposite side of the communicating section in a manner that the guide member preventing the ink from flowing to the communicating section directly from the ink supply hole.

19. The ink cartridge according to claim 18, wherein the ink supply hole is adjacent the one end of the ink chamber.

20. The ink cartridge according to claim 19, wherein the one end of the ink chamber is adjacent a bottom wall of the cartridge case.

* * * * *